US006302123B1

(12) United States Patent
Wilson

(10) Patent No.: US 6,302,123 B1
(45) Date of Patent: Oct. 16, 2001

(54) ROTARY LIQUID DIVERTER FOR INDUSTRIAL PARTS WASHER

(75) Inventor: Karle M. Wilson, West Chester, OH (US)

(73) Assignee: CAE Ransohoff Inc., Cincinnati, OH (US)

( * ) Notice: Subject to any disclaimer, the term of this patent is extended or adjusted under 35 U.S.C. 154(b) by 0 days.

(21) Appl. No.: 09/473,397

(22) Filed: Dec. 28, 1999

(51) Int. Cl.[7] ..... B08B 3/02; B08B 3/04

(52) U.S. Cl. ..... 134/95.3; 68/4; 68/208; 134/96.1; 134/115 R; 134/183; 137/579

(58) Field of Search ..... 134/95.1, 95.2, 134/95.3, 96.1, 111, 115 R, 155, 183, 186; 68/4, 208; 137/577, 579

(56) References Cited

U.S. PATENT DOCUMENTS

| | | | | |
|---|---|---|---|---|
| 474,394 | | 5/1892 | Lyman . | |
| 1,145,607 | * | 7/1915 | Morris | 137/579 |
| 1,853,529 | * | 4/1932 | Zademach | 137/579 X |
| 2,508,999 | * | 5/1950 | Hirsch | 134/111 X |
| 2,514,100 | * | 7/1950 | Spaulding | 134/186 X |
| 2,561,631 | * | 7/1951 | Negri | 134/111 X |
| 3,612,076 | | 10/1971 | Brahm | 134/102 |
| 3,884,263 | | 5/1975 | Wright | 137/571 |
| 3,884,265 | | 5/1975 | Fry et al. | 137/565 |
| 4,506,598 | | 3/1985 | Meister | 99/330 |
| 5,368,053 | | 11/1994 | Wilson | 134/95.2 |
| 5,385,084 | | 1/1995 | Laibson | 99/411 |
| 5,421,883 | | 6/1995 | Bowden | 118/73 |

* cited by examiner

*Primary Examiner*—Philip R. Coe
(74) *Attorney, Agent, or Firm*—Olson & Hierl, Ltd.

(57) ABSTRACT

A parts washing system comprises a wash liquid holding tank having a return opening, a rinse liquid holding tank also having a return opening, a wash chamber with drain port situated above both the wash liquid holding tank and the rinse liquid holding tank, a parts carrier movable from a loading position outside the wash chamber to a position inside the wash chamber, a nozzle adapted to direct liquid from one of the holding tanks into the wash chamber, at least one pump for transferring wash liquid and rinse liquid from the wash liquid holding tank and the rinse liquid holding tank to the spray nozzle, and a substantially L-shaped liquid diverter. The L-shaped liquid diverter is rotatably mounted at the drain port of the wash chamber for rotation in a substantially vertical plane. The L-shaped liquid diverter has an outlet end for dispensing liquid from the wash chamber to one of the wash liquid holding tank and the rinse liquid holding tank.

10 Claims, 5 Drawing Sheets

ROTARY LIQUID DIVERTER FOR INDUSTRIAL PARTS WASHER

TECHNICAL FIELD OF THE INVENTION

The present invention relates to liquid handling systems for automated washers and liquid-based treating equipment.

BACKGROUND OF THE INVENTION

In the industrial machine and equipment manufacturing industries, parts and castings which are subject to machining must be cleaned to remove cuttings, oils, chips and other contaminants. In a like manner, in other industries, including the maintenance industry, items such as vehicle parts must be cleaned to remove tars, oils, chips and metallic particles as well as other debris before the parts can be reused or replaced.

Parts washing machines generally include a wash chamber where parts are contacted in stages first by a wash liquid and a then by rinse liquid. The washing and rinse stages typically include one or more forms of agitation, such as high-pressure liquid or vapor spray, parts rotation, and ultrasonics. The washing and rinse cycles of a parts washing machine may entail both a spraying step, where liquid is sprayed onto parts in an air environment, and an overflow step, where parts are fully submerged in liquid and then agitated by combinations of turbolators, rotation, ultrasonics, spraying, and the like.

Automated parts washers typically include a liquid recycle system for cost reduction and environmental protection. In a conventional design, the associated drainage system for recycling liquid includes separate wash liquid and rinse liquid tanks, each coupled to the wash chamber by separate drainage passageways and control valves. This configuration allows a machine control system to drain liquid from the wash chamber to either holding tank as needed. This conventional approach has several significant drawbacks, however. First, such drainage systems require complicated valve setups and elaborate piping to provide the separate drainage passageways. Second, such systems suffer from limited drainage rates, which are insufficient to effectively flush debris from the wash chamber into the drainage system. Third, liquid treatment chambers linked to conventional drainage systems require separate means to prevent or control wash chamber overflow. Also, the parts washers of conventional design require a relatively large "footprint" on the factory floor.

Accordingly, there remains a need for a drainage system in a parts washing machine that overcomes one or more of these drawbacks.

SUMMARY OF THE INVENTION

The rotary liquid diverter of the present invention permits parts washing machines having liquid recycle systems to be both cost-effective and highly compact. The present liquid diverter reduces cycle times as well as the total volume of liquid required for washing and rinsing because piping volume is considerably reduced. Moreover, a truly overflowing rinse cycle can be implemented in a parts washing machine.

The liquid diverter is mountable to a drain port of a parts wash chamber situated above a wash liquid holding tank and a rinse liquid holding tank. The diverter includes a spout having an outlet end and an inlet end rotatably mounted to the drain port such that the spout is rotatable in a substantially vertical plane while in fluid communication with the wash chamber. Specifically, the spout is controllably rotatable about the drain port between an overflow position in which the outlet end is situated above the drain port and a drainage position in which the outlet is situated to dispense liquid contained in the parts wash chamber.

For washing parts where the wash chamber is to be substantially liquid full or overflowing, the spout can be rotated to an overflow position, which is preferably substantially upright or at a predetermined angle from the vertical. While the rotatable spout is in an overflow position, the wash chamber can be filled with liquid for parts submersion to the same level as the vertical position of the outlet end of the spout. In addition, the wash chamber can be controllably overflowed through the spout without a separate overflow outlet in the wash chamber. When the rotatable spout is in a drainage position, liquid from the wash chamber is directed to a liquid tank for recycle.

Liquid diverters according to the present invention can serve as general liquid overflow control devices for liquid holding tanks having a drain port. In this regard, the overflow control device comprises a spout having an outlet end and an inlet end. The spout of the overflow control device is mounted at its inlet end to the drain port for rotation in a substantially vertical plane so as to position the outlet end of the spout at an overflow station which is at a predetermined height above the drain port.

In a preferred embodiment of the present invention, a parts washing system is provided with an elevated wash chamber equipped with a rotary liquid diverter and a pair of liquid recycle tanks (or reservoirs). In particular, the parts washing system comprises a wash liquid holding tank having a return opening, a rinse liquid holding tank also having a return opening, a wash chamber with drain port situated above both the wash liquid holding tank and the rinse liquid holding tank, a parts carrier movable from a loading position outside the wash chamber to a position inside the wash chamber, a liquid spray nozzle adapted to direct liquid into the wash chamber, at least one pump for transferring wash liquid and rinse liquid from the wash liquid holding tank and the rinse liquid holding tank, respectively, to the spray nozzle, and a substantially L-shaped liquid diverter. The L-shaped liquid diverter is rotatably mounted at the drain port for rotation in a substantially vertical plane and has an outlet end for dispensing liquid from the wash chamber to one of the wash liquid holding tank and the rinse liquid holding tank.

The L-shaped diverter is rotatable to assume an array of functional positions, including four rotational positions which are particularly valuable for the operation of the parts washing machine. In a first position (or set of positions), the diverter outlet is situated over the return opening of the wash liquid tank at a level equal to or below the wash chamber drain port so that liquid in the wash chamber can drain into the wash liquid holding tank. In a second position, the diverter outlet is situated over the return opening of the wash liquid tank but at a level higher than the wash chamber drain port so that the wash chamber does not drain into the wash liquid tank but can instead overflow into the wash liquid tank.

While the first and second rotational positions noted above will direct fluid to the wash liquid holding tank, the diverter can rotate as well to corresponding positions for directing liquid to the rinse liquid holding tank. In a third position for example, the diverter outlet is situated over the return opening of the rinse liquid holding tank at a level equal to or below the wash chamber drain port so that liquid in the wash chamber drains into the rinse liquid tank. To provide overflow from the wash chamber to the rinse holding tank, a fourth position is also available where the outlet of the diverter is situated over the return opening of the rinse liquid holding tank but at a level higher than the drain port.

DESCRIPTION OF PREFERRED EMBODIMENTS

While this invention is susceptible to embodiment in many different forms, this specification and the accompanying drawings disclose only preferred forms as examples of the invention. The invention is not intended to be limited to the embodiments so described, however. The scope of the invention is identified in the appended claims.

Figure 1:
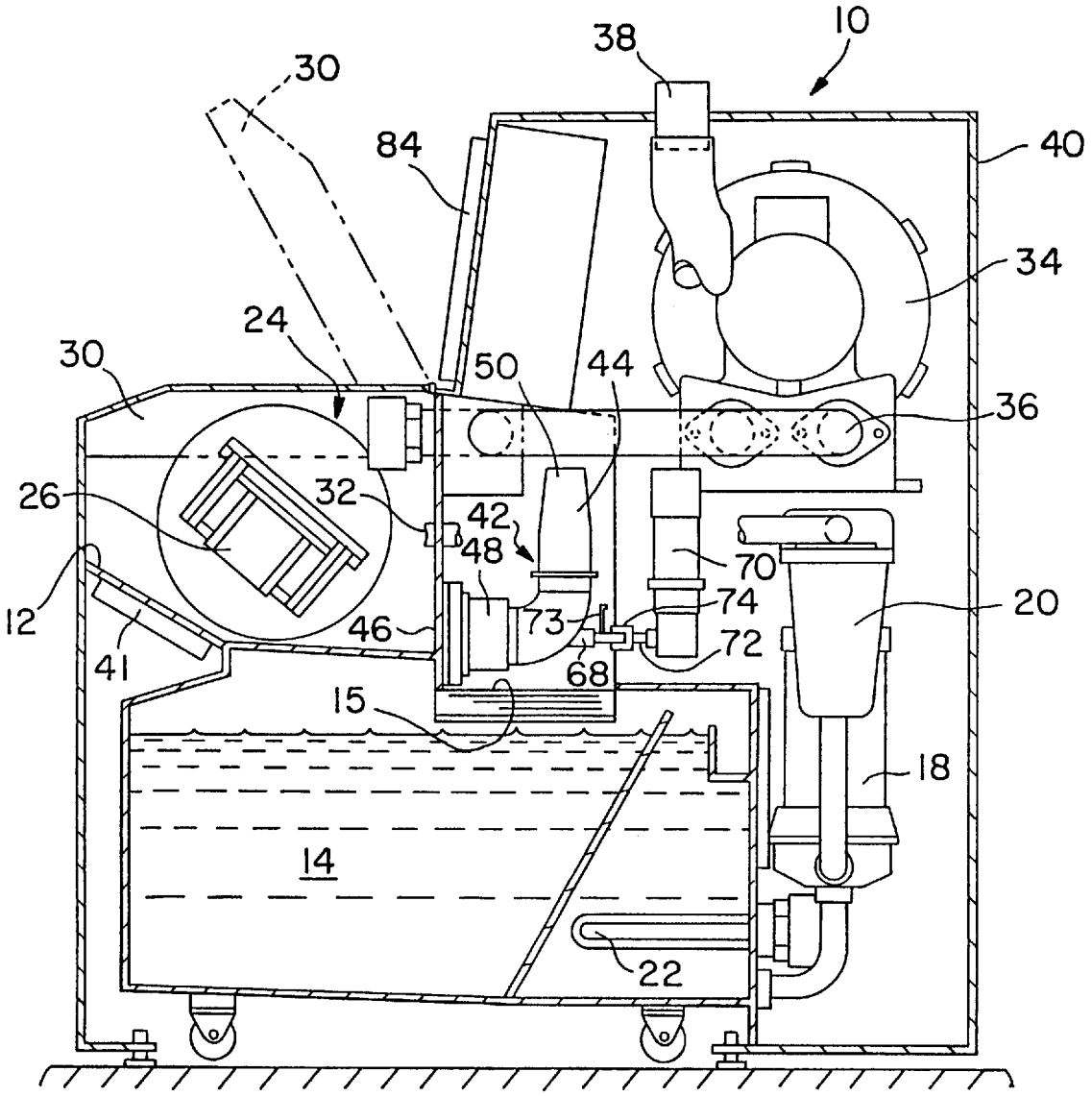
FIG. 1 is a schematic side view, partly in section, of a parts washing machine according to the present invention.
Figure 2:
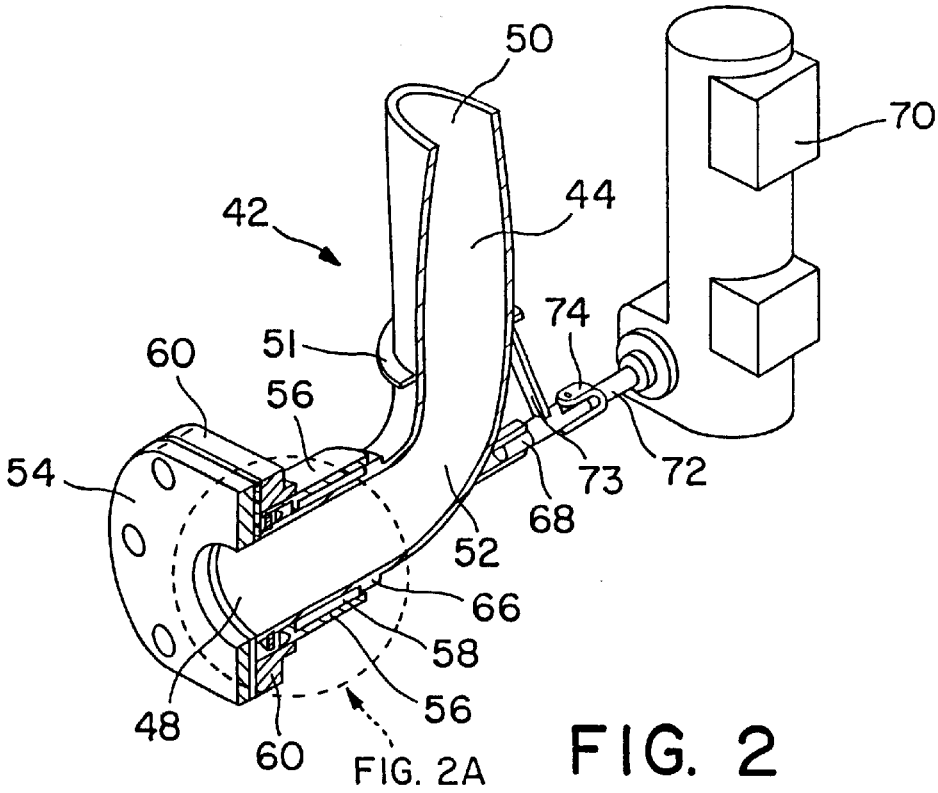
FIG. 2 is an enlarged perspective view of an L-shaped conduit (or spout), a rotational assembly, and drive motor according to the present invention, shown partially cut away to reveal interior detail.
Figure 3:
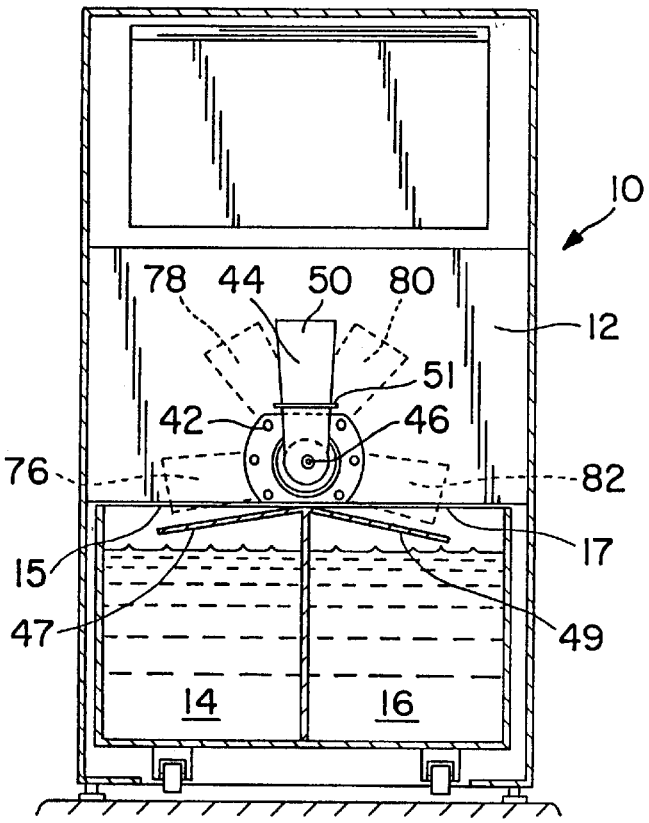
FIG. 3 is a cross-sectional rear view of the parts washing machine of FIG. 1, simplified to specially illustrate the liquid diverter and with four rotational positions depicted in phantom.
Figure 4:
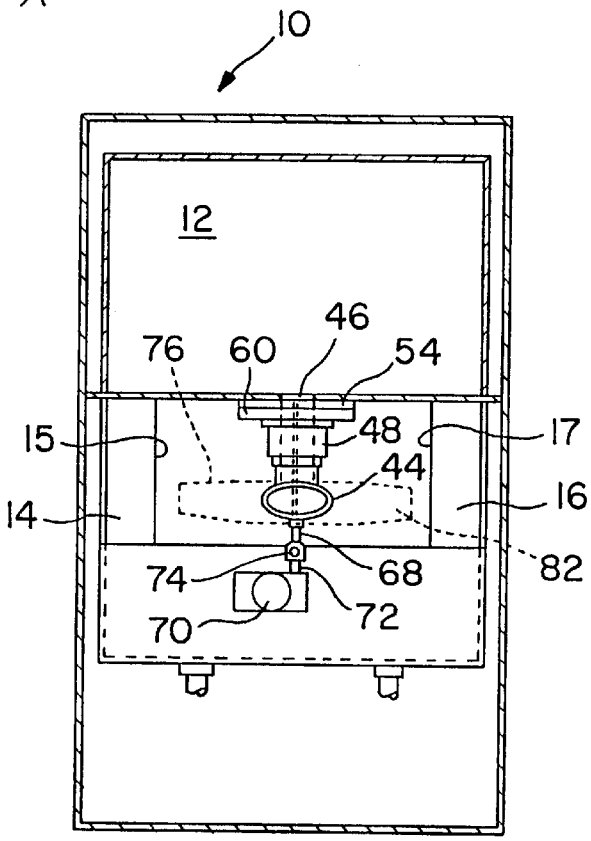
FIG. 4 is a cross-sectional plan view of the parts washing machine of FIG. 1 also simplified to specially illustrate the liquid diverter and some of its operating positions.

Referring to FIGS. 1 through 4, a parts washing machine 10 includes a parts wash chamber 12 positioned above a wash liquid holding tank 14 and a rinse liquid holding tank 16 (FIG. 3). Each holding tank 14 and 16 is individually equipped with a pump for transferring liquid to chamber 12 and an optional filter for removing debris and other impurities from the wash or rinse liquid, respectively. As expressly illustrated, tank 14 is served by a pump 18 and a filter 20. Each holding tank is also equipped with a heater, which is expressly identified for wash liquid holding tank 14 with reference numeral 22.

Secured within chamber 12 is a parts carrier 24, which preferably includes a mesh parts basket 26 removably secured thereto. An operator can place and remove parts basket 26 to and from chamber 12 through an access door 30. Wash liquid from tank 14 and rinse liquid from tank 16 enter chamber 12 through one or more nozzles, represented symbolically in FIG. 1 by reference numeral 32. An optional sonic wave generator 41 mounted to a front wall of chamber 12 can direct wave energy for enhanced parts cleaning. The composition of the wash liquid as well as the rinse liquid can vary depending upon the type of parts to be cleaned.

For machine cycles calling for parts drying or forced air, a blower 34 with ductwork 36 is provided to direct drying air onto parts placed in parts basket 26. A vent 38 is provided to release gases which would otherwise be trapped within wash chamber 12.

Machine 10 also includes a liquid diverter 42 for selectively directing liquid from chamber 12 to either wash liquid holding tank 14 or rinse liquid holding tank 16. Liquid diverter 42 includes a spout 44 rotatably mounted around a drain port 46 of chamber 12. For the embodiment of the present invention utilized in parts washing machine 10, drain port 46 takes the form of an access opening defined in chamber 12. Alternate arrangements are contemplated, however. For example, the wash chamber drain port may take the form of a conduit fitting attached to or unitary with a wall of chamber 12.

Figure 2A:
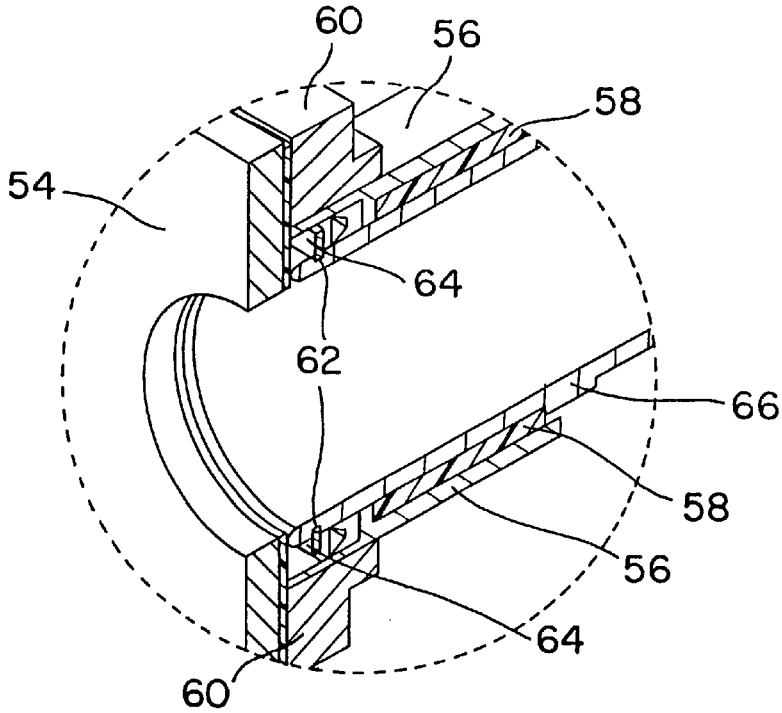
FIG. 2A is a further view of the rotational seal assembly shown in FIG. 2.

FIGS. 2 and 2A illustrate the assembly details of liquid diverter 42. Spout 44 is a substantially L-shaped conduit having an inlet end 48, an outlet end 50, and an elbow portion 52 therebetween. Spout 44 can be a multi-piece weldment or a single piece, as desired. The outlet end 50 of spout 44 can be round but preferably has an oval-shaped cross section as illustrated. A drip ring 51 around the outside surface of spout 44 is provided for deflecting any liquid flowing across the outside surface of the spout.

The inlet end 48 of spout 44 is mounted to chamber 12 in a sealed rotary joint assembly (or coupling) which is formed by a flange 54, a sleeve 56, a sleeve bearing 58, and a retaining collar or flange 60 for holding sleeve 56 about the inlet end 48 of spout 44. Inlet end 48 can have an optional circumferencial groove 62 (FIG. 2A) about its outer surface for receiving an optional rotor clip 64 and a raised collar 66 for securing sleeve bearing 58 between sleeve 56 and the inlet end 48 of spout 44.

To provide a turning point for rotating spout 44, a drive pin 68 is fixed at the elbow portion 52. Drive pin 68 is operably linked to a rotation drive actuator which can be a gear motor 70 with drive shaft 72. In such a case, an optional U-joint 74 preferably links drive pin 68 to shaft 72. Flag 73 on drive pin 68 is used in conjunction with a proximity sensor to indicate the position of spout 44. A wide variety of actuator types can be utilized for turning spout 44. Suitable are electric motors, pneumatic motors, hydraulic motors, as well as linear actuators.

Spout 44 is rotatable in a substantially vertical plane so that outlet end 50 can be raised above drain port 46. The term "substantially vertical plane" as used herein and in the appended claims means a plane that is no more than 40 degrees offset from a true vertical position. As best shown in phantom in FIGS. 3 and 4, spout 44 is controllably rotatable about drain port 46 between several operative positions. In either overflow position 78 or 80, chamber 12 can be liquid full because the outlet of spout 44 is situated above drain port 46. In position 78, the outlet of spout 44 is positioned over an access opening 15 in wash liquid holding tank 14 allowing overflowing liquid from chamber 12 to be captured by tank 14 for wash cycle operations. In position 80, the outlet of spout 44 is positioned over an access opening 17 in rinse liquid holding tank 16 allowing overflowing liquid from chamber 12 to be captured by tank 16 for rinse cycle operations.

In either position 76 or 82, the outlet of spout 44 is at or below the level of drain port 46 allowing liquid in chamber 12 to be drained to wash tank 14 and rinse tank 16, respectively. Optional deflector plates 47 and 49 can be provided to further control flow from spout 44, if desired.

Parts wash machine 12 can operate automatically via a control system which includes a programmable controller with control panel 84 operably linked to the various valves, pumps, blowers, and drive motors (e.g. motor 70) described above, and to various measuring instruments (e.g. tank level or temperature sensors). The control system is preferably programmable to allow operators to adjust the duration of steps or cycles of machine operation. To provide enhanced control over the rotational position of spout 44, liquid diverter 42 preferably includes proximity sensors or limit switches linked to the programmable controller that detect the position of flag 73 shown in FIG. 2.

The parts washing machine 10 preferably operates in the following sequence. A machine operator loads basket 26 with parts for cleaning, secures basket 26 within chamber 12, and closes access door 30. The operator pushes an enable button on control panel 84. Prior to that time, spout 44 has been rotated by gear motor 70 into position 78— substantially upright but slightly offset towards wash liquid holding tank 14 such that the outlet of spout 44 is situated over access opening 15.

Wash liquid pump 18 is then activated and wash chamber 12 is flooded with wash liquid from tank 14. Basket 26 is rotated as additional wash liquid enters chamber 12 at high pressure through nozzles 32. The additional wash liquid overflows chamber 12 forcing wash liquid through spout 44 and back into tank 14 for recycle. Nozzles 32 direct wash liquid at the parts in basket 26 to dislodge surface contaminants from the parts and to reorient the parts to allow the wash liquid to enter cavities in the parts and remove debris from internal recesses. When nozzles 32 are submerged in wash liquid during the wash cycle, they produce severe agitation in chamber 12 thus providing improved cleaning effect. The direction of basket rotation (e.g. clockwise) may be alternated for improved cleaning effect.

As the wash cycle ends following a preselected period, pump 18 continues pumping and basket rotation continues as well. Gear motor 70 rotates spout 44 into wash liquid drainage position 76 before pumping has stopped. In position 76, spout 44 is positioned at or below the level of drain port 46 but still over access opening 15 thereby draining wash liquid from chamber 12 into wash liquid holding tank 14. This quick emptying (or flushing) causes a high velocity torrent of fluid rushing out of chamber 12 which facilitates the removal of most of the accumulated debris.

After sufficient time has elapsed to drain chamber 12 into tank 14, spout 44 is next rotated to rinse liquid overflow position 80, where the outlet of spout 44 is again substantially upright but in this case slightly offset in the opposite direction so that outlet end 50 is over access opening 17 of liquid rinse holding tank 16. In this way, chamber 12 can be liquid full of rinse liquid, with any overflow of rinse liquid being diverted to holding tank 16 for recycle.

The rinse liquid pump is then activated to fill chamber 12 with rinse liquid from rinse liquid tank 16 as basket 26 continues to rotate. Additional rinse liquid is again forced into chamber 12 via nozzles 32, causing chamber 12 to overflow rinse liquid through diverter 42 and into rinse tank 16 for recycle. During the rinse cycle, the direction of basket rotation may again be alternated.

As the rinse cycle ends, basket rotation is continued and the rinse liquid pump continues pumping. Gear motor 70 rotates spout 44 to a rinse liquid drainage position 82, before pumping stops. At drainage position 82, outlet end 50 is at or below port 46 but still over access opening 17. In this way, rinse liquid is flushed from chamber 12 into rinse tank 16. With basket 26 remaining in rotation (or alternating rotation), blower 34 begins the drying cycle by directing air, which is optionally heated, at basket 26 via ductwork 36.

After a preselected period of drying, blower 34 is turned off and basket rotation ended. The operator can open door 30, which may be automatically locked during operation, to remove basket 26 and access the cleaned parts.

Figure 5:
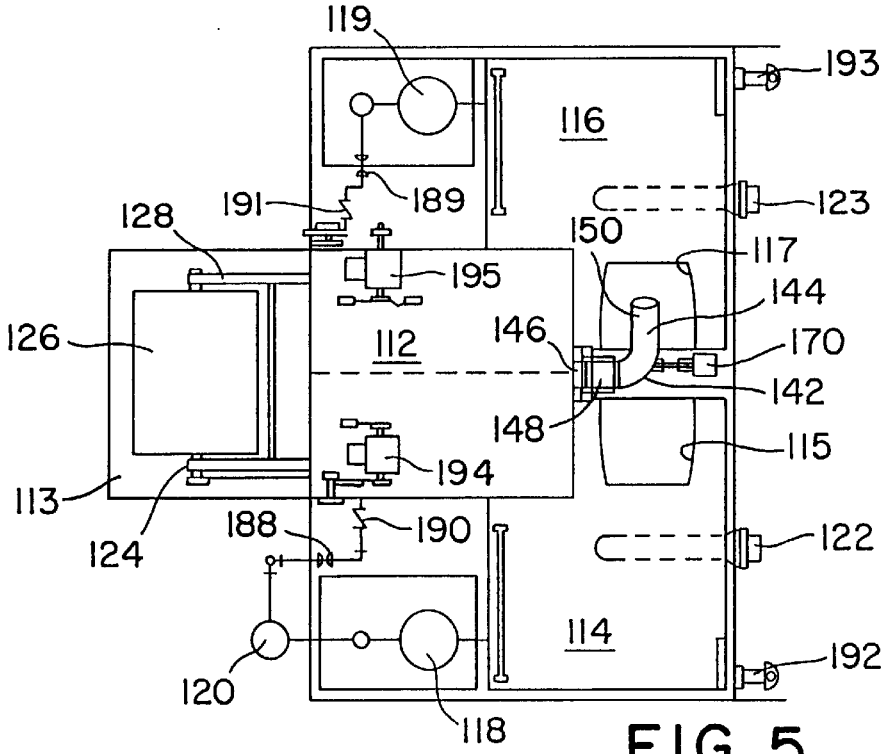
FIG. 5 is a schematic plan view of another parts cleaning machine equipped with a rotary liquid diverter according to the present invention.
Figure 6:
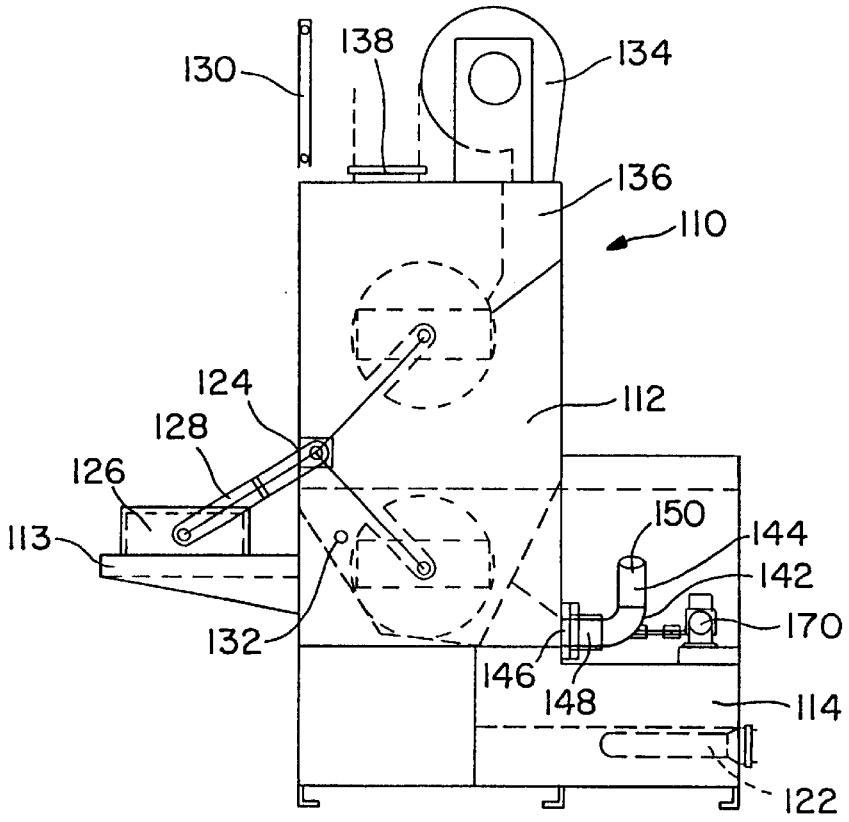
FIG. 6 is a schematic side view of the parts cleaning machine shown in FIG. 5.

FIGS. 5 and 6 depict another parts washing machine embodying the present invention. Within FIGS. 5 and 6, elements similar to those identified in FIGS. 1 through 4 have been assigned corresponding reference numbers. A parts washing machine 110 includes a wash chamber 112, a wash liquid holding tank 114 and a rinse liquid holding tank 116. Wash chamber 112 is elevated with respect to the tanks 114 and 116. Parts washing machine 110 includes pumps 118 and 119 for transferring wash and rinse liquid from holding tanks 114 and 116 to wash chamber 112. The wash liquid is preferably pumped through a filter 120. Control valve 188 and check valve 190 regulate the flow of wash liquid from holding tank 114 to wash chamber 112, while control valve 189 and check valve 191 regulate the flow of rinse liquid to wash chamber 114. Holding tanks 114 and 116 each preferably include drain plugs 192 and 193, heaters 122 and 123, float switches (not shown), and access openings 115 and 117 for liquid return.

Parts washing machine 110 also includes a parts carrier 124 that is movable from a loading position outside wash chamber 112 to operating positions inside wash chamber 112. Optional parts carrier 124 is preferably a subassembly comprising a hoist frame 128 and a mesh basket 126 for holding parts. Loading shelf 113 supports basket 126 during parts loading. Wash chamber 112 includes an access door 130 that can be air operated.

A bidirectional drive motor 194 is adapted to rotate basket 126 for enhanced cleaning effect. A fan 134 with duct 136 directs filtered drying air into wash chamber 112. A vent connection 138 is provided in a top wall of wash chamber 112.

Parts washing machine 110 is equipped with a liquid diverter 142 for selectively directing liquid from chamber 112 to either wash liquid holding tank 114 or rinse liquid holding tank 116. Liquid diverter 142 includes an L-shaped conduit (or spout) 144 rotatably mounted around a drain port 146 of chamber 112.

Parts washing machine 110 preferably operates in the following sequence. An operator pushes an enable button (not shown) activating pump 118 which circulates wash liquid in the holding tank. An operator loads basket 126 with parts for cleaning and pushes a cycle start button (not shown). Door 130 is open and motor 195 moves basket 126 from the loading position on shelf 113 to a relatively lower cleaning position within chamber 112.

After door 130 is closed, the wash liquid enters the chamber 112 through nozzles, symbolically indicated by reference numeral 132 in FIG. 6. A motor 195 rotates basket 126 in a first direction (e.g. clockwise) for preselected time interval and then rotates basket 126 in the opposite direction (e.g. counterclockwise) for another preselected interval. Basket 126 is next alternately rotated clockwise and counterclockwise in subsequent intervals of, for example, 30 seconds each. During the wash cycle, L-shaped conduit 144 is positioned by rotation driver 170 to be substantially upright but slightly offset towards wash liquid holding tank 114 such that the outlet end 150 of spout 144 is over tank opening 115 of tank 114. This wash liquid overflow position for L-shaped conduit 144 allows chamber 112 to be liquid full, while also providing for wash liquid to overflow into holding tank 114. As basket 126 is rotated in chamber 112 during the wash cycle, nozzles 132 direct wash liquid at the parts in basket 126.

When the wash cycle ends, pump 118 keeps pumping and motor 195 continues to rotate basket 126 as L-shaped spout 144 is rotated by rotation drive 170 into a wash liquid drainage position. In the wash liquid drainage position, open end 150 of L-shaped conduit 144 is lower than drain port 146 and still over tank opening 115 thereby diverting wash liquid from chamber 112 to wash liquid holding tank 114. Pump 118 continues to spray wash liquid during draining as determined by the program sequence.

After sufficient time has elapsed to drain chamber 112 into tank 114, L-shaped conduit 144 is rotated to a rinse liquid overflow position, where it is again substantially upright but in this case slightly offset in the opposite direction towards rinse liquid holding tank 116 so that the outlet end 150 is over tank opening 117. In this way, chamber 112 can be liquid full, with any overflowing rinse liquid being diverted to holding tank for recycle.

With the L-shaped conduit in rinse overflow position, pump 119 is activated to fill chamber 112 with rinse liquid from rinse liquid tank 116 as motor 195 continues to rotate basket 126. During the rinse cycle, basket 126 is again alternatively rotated clockwise and then counterclockwise for preselected intervals, e.g. 30 seconds each. As the rinse cycle ends, pump 119 continues pumping and basket 126 is moved by motor 194 from the lower cleaning position to an upper position within chamber 12 for draining and drying. For drying and draining motor 195 continues to rotate basket 126. Rotation drive 170 lowers the outlet end 150 of L-shaped conduit 144 into a rinse liquid drainage position before pump 119 is turned off. Outlet end 150 remains over the rinse tank opening 117 but is now positioned at or below the level of drain port 146. In this way, rinse liquid is flushed from chamber 112 into wash liquid holding tank 116. Pump 119 is turned off before the drying operation starts.

With basket 126 remaining in alternating rotation, fan 134 is activated to begin a drying cycle. Fan 134 blows air at basket 126 via duct 136. As the drying cycle ends, fan 134 and basket 126 are turned off. After a sufficient delay period to allow basket 126 to end rotation, door 130 is opened and basket 126 is moved to shelf 113.

Figure 7:
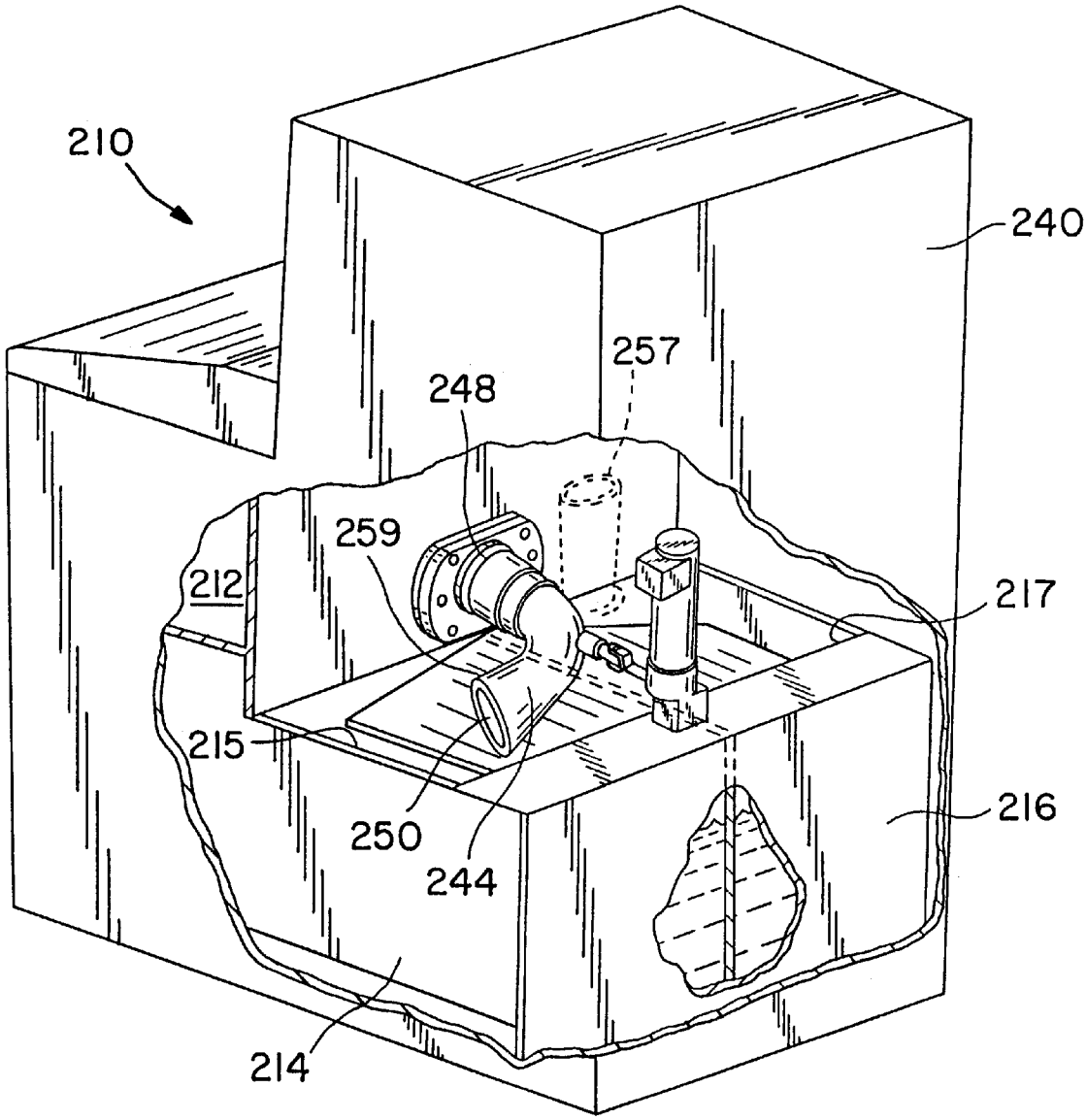
FIG. 7 is a partially cutaway, perspective view of a generic liquid treatment machine simplified to specially illustrate a liquid diverter according to the present invention adapted for use with a working tank and relatively lower liquid holding tanks.

Referring now to FIG. 7, a generic liquid treatment machine 210 is illustrated to demonstrate the various possible applications for rotary liquid diverters according to the present invention. Machine 210 includes a working chamber 212, where reusable liquids are utilized, and liquid or solution holding tanks 214 and 216 for storing liquids. A housing 240 surrounds the various components of machine 210. A spout 244, which could also be labelled a nozzle, is rotatably mounted for rotation on a substantially vertical plane to a drain port defined in a sidewall of working chamber 212. Specifically, spout 244 has an inlet end 248 mounted to working chamber 212 via a rotational coupling and an outlet end 250. As illustrated, spout 244 is controllably rotatable in a substantially vertical plane to a variety of functional positions (or stations), some positions allowing working chamber 212 to be liquid full and other positions providing for rapid drainage. Specifically illustrated in FIG. 7 are overflow station 257, where outlet end 250 is situated above the drain port, and dump station 259, where outlet end 250 is situated below the drain port.

The present invention offers several key features to parts washing and other liquid utilizing systems. Parts washing machines configured according to the present invention have flexible liquid recycle capabilities without the elaborate piping networks required for conventional designs. By avoiding elaborate piping networks, the overall size and footprint of parts washing machines can be significantly reduced without sacrificing cleaning capacity.

A related feature of the present invention is integrated overflow handling for wash as well as rinse cycles. Machines equipped according to the present invention do not require a separate system of ports and piping to manage liquid overflow through the wash chamber during the wash cycle as well as the rinse cycle. This overflow feature also facilitates the design of relatively smaller machines for performing the same parts washing task as well as machines that require a relatively lesser liquid volume for operation. This, in turn, reduces the heating requirements for the treating liquids with additional cost savings.

Also a significant feature, wash chamber drainage can be greatly increased without providing more expensive, relatively large-diameter piping and associated control valves. Rapid drainage benefits overall wash machine operations because debris removed from cleaned parts is more readily swept into the recycle tanks for later disposal thereby limiting the need for manual cleaning of the wash chamber.

Numerous variations and modifications of the embodiments described above may be effected without departing from the spirit and scope of the novel features of the invention. It is to be understood that no limitations with respect to the specific system illustrated herein are intended or should be inferred. It is, of course, intended to cover by the appended claims all such modifications as fall within the scope of the claims.

I claim:

1. A liquid diverter mounted to a drain port of a parts wash chamber in a parts washing machine, situated above a wash liquid holding tank, the diverter comprising:

a substantially L-shaped spout having an outlet end and an inlet end rotatably mounted to the drain port such that the spout is in fluid communication with the wash chamber and is rotatable in a substantially vertical plane;

the spout being controllably rotatable by a rotation drive actuator operably coupled to the spout about the drain port between an overflow position in which the outlet end is situated above the drain port and a drainage position in which the outlet end is situated to dispense liquid contained in the parts wash chamber; and wherein the spout includes a drip ring around the outside surface thereof for deflecting liquid flowing across the outside surface of the spout.

2. A liquid diverter as in claim 1 wherein the rotation drive actuator is an electric motor having a drive shaft operably coupled to the spout.

3. A liquid diverter as in claim 1 wherein the rotation drive actuator is an hydraulic motor having a drive shaft operably coupled to the spout.

4. A liquid diverter as in claim 1 wherein the rotation drive actuator is an pneumatic motor having a drive shaft operably coupled to the spout.

5. A liquid diverter as in claim 1 wherein the rotation drive actuator is a linear actuator operably coupled to the spout.

6. A liquid diverter mounted to a drain port of a parts wash chamber in a parts washing machine, situated above a wash liquid holding tank, the diverter comprising:

a substantially L-shaped spout having an outlet end and an inlet end rotatably mounted to the drain port such that the spout is in fluid communication with the wash chamber and is rotatable in a substantially vertical plane;

the spout being controllably rotatable by a rotation drive actuator operably coupled to the spout about the drain port between an overflow position in which the outlet end is situated above the drain port and a drainage position in which the outlet end is situated to dispense liquid contained in the parts wash chamber; and wherein the parts wash chamber is situated above a rinse liquid holding tank having an access opening and the spout is rotatable about the drain port to and from a rinse tank drainage position wherein the nozzle outlet end is situated over the access opening to dispense liquid contained in the parts wash chamber to the rinse liquid holding tank.

7. A liquid diverter suitable for use with a parts wash chamber in a parts washing machine and having a drain port, the liquid diverter comprising:

a substantially L-shaped conduit having an outlet end and an inlet end mounted to the drain port such that the L-shaped conduit is in fluid communication with parts wash chamber, the L-shaped conduit being rotatable about the drain port in a substantially vertical plane to dispense liquid from the wash chamber; and a rotation drive operably coupled to the L-shaped conduit wherein the rotation drive is a motor having a drive shaft operably coupled to the spout.

8. A liquid diverter adapted to be operably positioned between an overflow station and a dump station of a parts treatment chamber in a parts treating machine above a liquid holding tank having an access opening, the diverter comprising:

a nozzle in fluid communication with the parts treatment chamber and having an outlet end and an inlet end, the nozzle being controllably rotatable about the drain port between an overflow station where the outlet end is situated above the drain opening and over the access opening and a dump station where the outlet end is situated to dispense liquid from the wash chamber into the holding tank.

9. A parts washing system comprising:

a wash liquid holding tank having a return opening;

a rinse liquid holding tank having a return opening;

a wash chamber above the wash liquid holding tank and the rinse liquid holding tank, the wash chamber having a drain port;

a parts carrier secured within said wash chamber;

a nozzle in communication with at least one of the holding tanks and adapted to direct liquid into the wash chamber;

at least one pump for transferring wash liquid and rinse liquid from the wash liquid holding tank and the rinse liquid holding tank, respectively, to the nozzle; and a substantially L-shaped liquid diverter rotatably mounted at the drain port for rotation in a substantially vertical plane and having an open outlet end for dispensing liquid from the wash chamber to one of the wash liquid holding tank and the rinse liquid holding tank.

10. The parts cleaning system of claim 9 wherein the parts carrier is movable from a loading position outside the wash chamber to a position inside the wash chamber.

* * * * *